United States Patent [19]

Buchwalder

[11] Patent Number: 4,484,659

[45] Date of Patent: Nov. 27, 1984

[54] DEVICE FOR MODULATING THE FLOW OF THE GASES IN AN INTERNAL COMBUSTION ENGINE EXHAUST MUFFLER

[75] Inventor: Jean-Pierre Buchwalder, Seloncourt, France

[73] Assignee: Cycles Peugeot, Valentigney, France

[21] Appl. No.: 422,919

[22] Filed: Sep. 24, 1982

[30] Foreign Application Priority Data

Oct. 14, 1981 [FR] France ..... 81 19304

[51] Int. Cl.[3] ..... F01N 1/08

[52] U.S. Cl. ..... 181/266; 181/237; 181/272; 181/273; 181/278

[58] Field of Search ..... 181/237, 254, 265, 266, 181/278, 272, 273

[56] References Cited

U.S. PATENT DOCUMENTS 3,090,677 5/1963 Scheitlin et al. ..... 181/254 X
3,620,330 11/1971 Hall ..... 181/266
3,783,590 1/1974 Allen ..... 181/237 X

*Primary Examiner*—Benjamin R. Fuller
*Attorney, Agent, or Firm*—Sughrue, Mion, Zinn, Macpeak and Seas

[57] ABSTRACT

The muffler comprises a resonator (6) which communicates by way of an outlet orifice (14) with a chamber (5). A flexible valve member (16) regulates the section of the passage through this orifice in accordance with the rate of flow of the gas through the outlet of the resonator under the action, for example, of the pressure prevailing in the resonator. When the running speed of the engine decreases, the valve member reduces the section of the passage through the orifice (16) and modifies the acoustic attenuation in the resonator. The valve member may be controlled by other parameters of the flow of the exhaust gas inside the muffler.

7 Claims, 4 Drawing Figures

Figure 1:
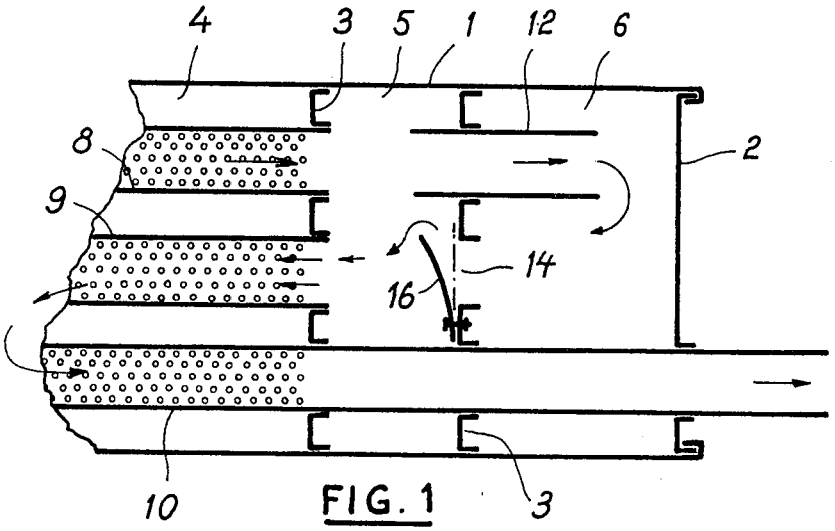

DEVICE FOR MODULATING THE FLOW OF THE GASES IN AN INTERNAL COMBUSTION ENGINE EXHAUST MUFFLER

DESCRIPTION

The reduction in the noise emitted by internal combustion heat engines requires systems, and in particular exhaust mufflers, which must be more and more effective. Thus the use of mufflers incorporating open or closed resonators has become general practice. These mufflers indeed give on the whole good results but remain insufficient under many circumstances, their effectiveness varying with the running speed of the engine.

An object of the present invention is to overcome these drawbacks by enabling the acoustic design of the muffler to be modified as a function of the running speed of the engine.

The invention therefore provides a device for modulating the flow of the gases inside an exhaust muffler comprising, in a closed case, at least two perforated tubes through which the exhaust gas travels in series, and an open resonator which includes in the resonator an orifice provided with a valve for regulating the section of the passage through the orifice, the valve being controlled by the flux of the exhaust gas, ie. by the running speed of the engine.

According to a preferred embodiment, the valve regulates the section of the passage through an orifice which puts the resonator in communication with a chamber of the muffler.

The flow of gases issuing from the resonator and entering the chamber of the muffler is thus automatically modified as a function of the exhaust gas flux. It increases with increase in the flux of the gas, ie. with the running speed of the engine.

The valve may be controlled by various parameters of the exhaust gas flux, for example by the pressure or the temperature inside the resonator or by the speed of the outlet flux of the muffler.

According to a modification, the valve regulates an orifice which puts the resonator in communication with an inlet tube or pressure take-off tube as a function of the outlet speed of the exhaust flux.

The advantages and features of the invention will be brought out in the ensuing description of embodiments which are given merely by way of example and shown in the accompanying drawings.

Figure 2:
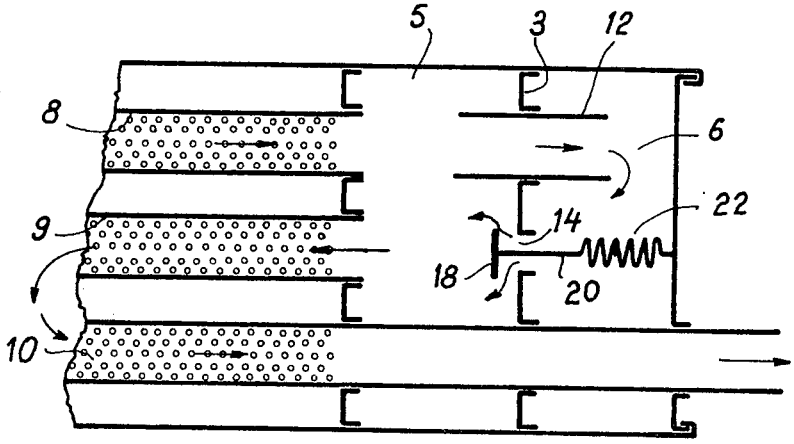
Figure 3:
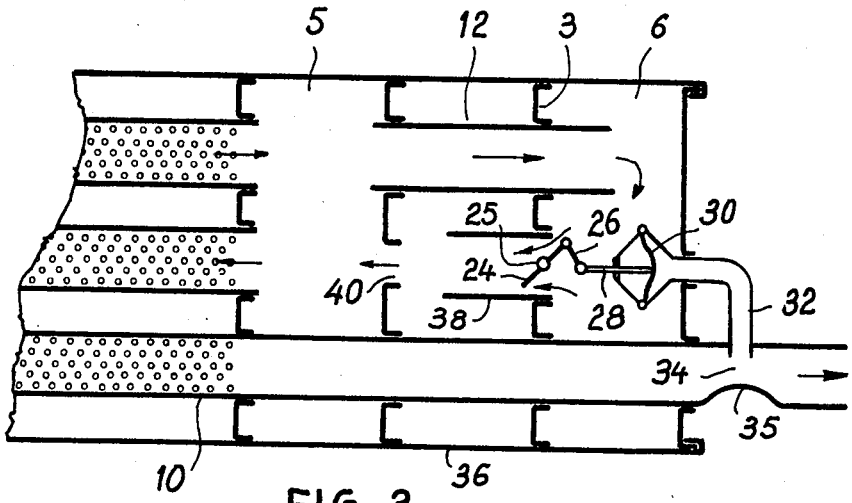
Figure 4:
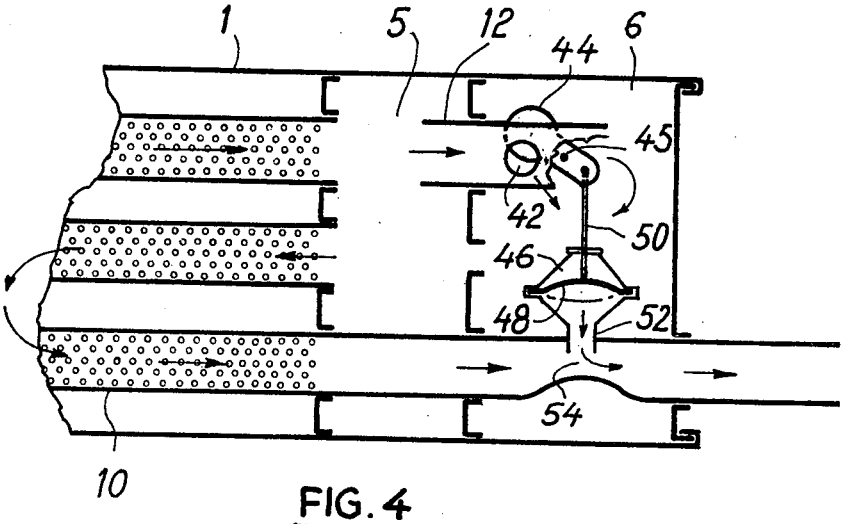

In the drawings:

FIG. 1 is a partial diagrammatic longitudinal sectional view of a muffler provided with a device according to the invention, and FIGS. 2, 3 and 4 are similar views of mufflers comprising modulating devices according to other embodiments.

The illustrated muffler is of the type having a resonator and comprises consequently a case 1 closed at each end by a dished wall 2 and divided by a number of inner dished walls 3 into a number of chambers, eg. the illustrated chambers 4, 5 and 6. A plurality of tubes 8, 9 and 10 are mounted in parallel relation in the case 1 and communicate with one another both through their perforations and through the chambers, such as the chamber 5, onto which two of the tubes open.

The chamber 6 also communicates with the chamber 5 through a tube 12 which is a pressure take-off tube and thus constitutes a resonator. An orifice 14 provided in the partition wall 3 which separates the chambers 6 and 5 constitutes an outlet for this resonator. As shown by the arrows in FIG. 1, the tubes 8, 9, 10 and 12, the orifice 14 and the chambers 5 and 6 constitute an exhaust gas flow circuit through the muffler.

According to the invention, a flexible valve member 16 is secured to the partition wall 3 in the region of the orifice 14 and tends to be constantly applied against the edge of this orifice in the manner of a closing member. However, when the pressure in the chamber 6 increases sufficiently to exceed that prevailing in the chamber 5, the valve member 16 gradually opens. The flexibility of the valve member 16 thus constitutes parameter responsive means responsive to the pressure prevailing in the gas flow circuit and more precisely the resonator 6 and defines therebetween and said orifice 14 a passage whose section depends on the pressure inside the resonator 6.

It will be clear that the rate of flow of the gas inside the tubes 8, 9 and 10 increases with the running speed of the engine. Consequently, the pressure prevailing in the resonator is also high. On the other hand, as soon as the running speed of the engine decreases, the pressure also decreases in the resonator so that the valve 16 tends to close the passage through the orifice 14.

The displacement of the valve 16 and the variation in the section of the passage through the orifice 14 modify the operation of the resonator and adapt the acoustic attenuation achieved to the flux of the gas which flows therethrough, ie. to the running speed of the engine. Further, the slowing down of the flow produced by the reduction in the section of the orifice 14, or even the closure of this orifice, eliminates any suction phenomenon in the inlet tube 8 in the direction of the engine and consequently considerably reduces the risk of the introduction of fuel in the muffler.

The valve regulating the section of the orifice 14 may of course be controlled by a parameter other than the flow of the exhaust gas. For example, as shown in FIG. 2, the muffler may comprise a guided valve 18 carried by a rod 20 which extends through the orifice 14 and is rigid with parameter responsive means in the form of an expansible strip 22 responsive to the temperature prevailing in the resonator 6. The expansion strip 22 preferably bears against the closing dished wall 2 of the muffler so that, upon expansion, it urges the rod 20 toward the chamber 5 and separates the valve member 18 from the orifice 14.

The position of the guided valve member 18 relative to the partition wall 3 determines the area of the section of the passage of the fluid through the orifice 14 and depends on the expansion of the strip 22 which in turn depends on the running speed of the engine, since the variation in the temperature of the gases in the resonator is proportional to the variation in this speed.

According to another embodiment shown in FIG. 3, the outlet orifice 14 of the resonator 6 is regulated by means of a valve member of the butterfly type 24 which pivots about a spindle 25 and is controlled by the flow of the gas in the outlet tube 10 of the muffler. Indeed, the butterfly valve member 24 is connected through a link 26 articulated at both ends, to a slidable rod 28 fixed to parameter responsive means in the form of a diaphragm 30 of a manometric capsule. A tube 32 of small diameter connects the capsule to the outlet tube of the muffler so that the diaphragm 30 is subjected to the difference between the pressure prevailing in the resonator and in the narrow tube 32. Now, the flux of gas flowing in the outlet tube 10 creates in the tube 32 a depression which is proportional to the flow in the tube 10 so that the position of the diaphgram 30 varies at the same time as the flow of the exhaust gas inside the muffler and in particular in the outlet tube 10, ie. at the same time as the running speed of the engine. of the outlet end a constricted passage 34 constituted by a local deformation of its wall or an inner boss 35, and the narrow plunging tube 32 opens onto this constricted passage. The exhaust gases issuing from the tube 10 are thus accelerated by the constricted passage 34 so that they produce an increased depression in the tube 32 and facilitate the action of the diaphragm 30 on the butterfly valve member 24.

With this device, as with the other preceding devices, the outlet orifice 14 of the resonator has a section of passage which varies with the running speed of the engine. The butterfly valve member 24 indeed gradually opens this orifice under the action of the depression created in the tube 32, ie. as the flow of gas through the tube 10 increases. On the other hand, when the running speed of the engine decreases, the speed of the gas flux in the outlet tube 10 decreases and the butterfly valve member 24 tends to close the orifice 14.

It will be understood that the orifice 14 may be an orifice which puts the chamber of the resonator 6 in communication with the chamber 5, but it may also, in accordance with a modification shown in FIG. 3, permit the chamber of the resonator 6 to be put in communication with an intermediate chamber 36, a tube 38 being preferably mounted in the orifice 14 and opening onto the chamber 36 which communicates with the chamber 5 by way of an orifice 40 and thus constitutes a second open resonator.

As in the preceding embodiments, the device for modulating the flow modifies the characteristics of the acoustic attenuation of the muffler as a function of the running speed of the engine.

In some cases, however, it may be preferable to modify the flow of the gases at the entrance of the resonator and not at its exit. An orifice 42 is then preferably provided in the pressure take-off tube 12 of the resonator 6 inside the latter. A shutter valve member 44 pivoting on a pin 45 may move in front of the tube 12 and more or less completely close the orifice 42 under the action parameter responsive means in the form of a manometric capsule 46 to the diaphragm 48 of which it is connected by a slidable rod 50. The diaphragm 48 is subjected to the pressure prevailing in a narrow tube 52 which opens onto the outlet tube 10 of the exhaust gases in the region of a constricted passage 54. As in the preceding embodiment, the constricted passage 54 is preferably formed by a local deformation 55 of the wall of the tube 10. Whatever be the manner in which it is constricted, this constricted passage 54 accelerates the outlet flux of the muffler and consequently increases the depression in the tube 52 and the deformation of the diaphragm 48. Under the effect of this deformation, the shutter 44 gradually opens the orifice 42 as the speed of the gases in the tube 10 increases and, on the other hand, gradually closes this orifice when this speed decreases, ie. as the running speed of the engine decreases.

The opening of the orifice 42 has the same effect as a shortening of the length of the pressure take-off tube 12 of the resonator and consequently modifies the frequency of the gas inside this resonator and enables the muffler to be adapted to the running speed of the engine at each instant.

Having now described my invention what I claim as new and desire to secure by Letters Patent is:

1. A device for modulating the flow of the exhaust gases in an internal combustion engine exhaust muffler, said muffler comprising a closed case and, inside the case, wall means defining a plurality of chambers, one of which chambers constitutes an open resonator, passage means which include perforated tubes and partly extend through said chambers and partly include said chambers and constitute an exhaust gas flow circuit including said resonator and having an exhaust gas discharging end, said passage means including means defining an orifice in the wall means defining said resonator for putting said resonator in communication with one of said chambers, a movable valve member cooperative with the orifice for defining a passage between said orifice and said valve member which passage is variable according to the position of said valve member, and parameter responsive means disposed within the muffler and responsive to a parameter of the exhaust gases flowing through said flow circuit, which parameter varies with the running speed of the engine, said parameter responsive means being combined with said valve member for controlling the position of said valve member relative to said orifice in accordance with said parameter, said valve member being solely operative on said orifice and leaving the rest of said circuit apart from said resonator structurally permanently unaffected thereby.

2. A device according to claim 1, wherein said valve member is flexibly applied against and closes said orifice and is movable away from said orifice by bending and said parameter is pressure prevailing inside the resonator.

3. A device according to claim 1, wherein said parameter responsive means comprises a strip which is disposed inside said resonator and expansible under the action of heat and operatively connected to the valve member.

4. A device for modulating the flow of the exhaust gases in an internal combustion engine exhaust muffler, said muffler comprising a closed case and, inside said case, wall means defining a plurality of chambers, one of which chambers constitues an open resonator, passage means which include perforated tubes and an outlet tube, partly extend through said chambers, partly include said chambers and constitute an exhaust gas flow circuit including said resonator, said passage means including means defining an orifice in the wall means defining said resonator for putting said resonator in communication with one of said chambers, a pivotable valve member cooperative with said orifice for defining a passage between said orifice and said valve member which passage is variable according to the position of said valve member, a manometric capsule which includes a diaphragm, and a narrow depression tube which puts said manometric capsule in communication with said outlet tube, said diaphragm being connected to said valve member for pivoting said valve member.

5. A device according to claim 4, wherein the narrow depression tube opens onto a constricted passage of the outlet tube of the muffler.

6. A device according to claim 4 or 5, wherein the pivotal valve member is mounted at an inlet orifice of a tube connecting the resonator to one of said chambers of the muffler.

7. A device according to claim 4 or 5, wherein the pivotal valve member is mounted on a pressure take-off tube of the resonator and said orifice is provided in said pressure take-off tube.

* * * * *